US006920937B2

(12) United States Patent
Neill et al.

(10) Patent No.: US 6,920,937 B2
(45) Date of Patent: Jul. 26, 2005

(54) DECK/HALL EXTENDED COVERAGE HORIZONTAL SPRINKLER ARRANGEMENT

(75) Inventors: John Neill, Edgewater, NJ (US); Salvatore S. Rachiele, Bronx, NY (US)

(73) Assignee: The Reliable Automatic Sprinkler Co., Inc., Mount Vernon, NY (US)

( * ) Notice: Subject to any disclaimer, the term of this patent is extended or adjusted under 35 U.S.C. 154(b) by 128 days.

(21) Appl. No.: 10/156,569

(22) Filed: May 28, 2002

(65) Prior Publication Data

US 2003/0222155 A1 Dec. 4, 2003

(51) Int. Cl.[7] ..... A62C 37/08

(52) U.S. Cl. ..... 169/37; 239/223; 239/523; 239/461; 239/518

(58) Field of Search ..... 169/37; 239/461–524, 239/222.17, 222.22, 223, 224

(56) References Cited

U.S. PATENT DOCUMENTS

| | | | | | |
|---|---|---|---|---|---|
| 1,778,994 | A | * | 10/1930 | Allen | 239/275 |
| 1,943,073 | A | * | 1/1934 | Heverly et al. | 239/222.19 |
| 2,101,694 | A | * | 12/1937 | Tyden | 239/500 |
| 2,465,420 | A | * | 3/1949 | Barnett | 239/222.17 |
| 2,481,363 | A | * | 9/1949 | Strock | 239/222.17 |
| 3,146,823 | A | * | 9/1964 | Loveland | 239/518 |
| 4,296,815 | A | | 10/1981 | Mears | |
| 4,296,816 | A | | 10/1981 | Fischer | |
| 4,585,069 | A | | 4/1986 | Whitaker | |
| 4,987,957 | A | | 1/1991 | Galaszewski | |
| 5,669,449 | A | | 9/1997 | Polan et al. | |
| 5,722,599 | A | | 3/1998 | Fries | |
| 5,727,737 | A | | 3/1998 | Bosio et al. | |
| 5,810,263 | A | | 9/1998 | Tramm | |
| 6,076,746 | A | * | 6/2000 | Kantor et al. | 239/222.17 |
| 6,098,718 | A | | 8/2000 | Sato | |

* cited by examiner

*Primary Examiner*—Dinh Q. Nguyen
(74) *Attorney, Agent, or Firm*—Baker Botts LLP

(57) ABSTRACT

In the embodiments described in the specification, a deck/hall extended coverage horizontal sprinkler arrangement has a sprinkler body with frame arms oriented in a vertical plane and a deflector mounted on the frame arms having semi-conical sections on opposite sides of the frame arms. The semi-conical sections are open in the direction toward the sprinkler orifice and include centrally located horizontal openings with vanes extending forwardly above the opening and top surfaces which are flattened and extend outwardly beyond the edges of the conical surfaces of the semi-conical sections.

19 Claims, 3 Drawing Sheets

DECK/HALL EXTENDED COVERAGE HORIZONTAL SPRINKLER ARRANGEMENT

BACKGROUND OF THE INVENTION

This invention relates to horizontal sprinkler arrangements for protecting long, relatively narrow areas such as halls or decks.

Most conventional horizontal sprinklers are designed to direct water forwardly in the direction of the sprinkler axis to a greater extent than in directions on opposite sides of the sprinkler axis. Typical horizontal sprinklers of this type are disclosed in U.S. Pat. Nos. 4,296,815; 4,296,816; 4,987,957; 5,722,599; 5,727,737; and 5,810,263. None of those sprinklers is effective to protect a long, relatively narrow space such as a hall or deck.

SUMMARY OF THE INVENTION

Accordingly, this is an object of the present invention to provide a horizontal sprinkler arrangement which is effective to distribute water over an area which has a greater dimension in the direction perpendicular to the sprinkler axis than in the direction parallel to the sprinkler axis.

Another object of the invention is to provide an extended coverage horizontal sprinkler arrangement for protection of a deck or hall space.

These and other objects of the invention are attained by providing a sprinkler arrangement which includes a sprinkler body with an outlet orifice and a deflector supported in spaced relation to the outlet orifice having two semi-conical sections disposed on opposite sides of the sprinkler axis which are open in the direction facing the orifice. In a preferred embodiment each of the semi-conical sections has a generally horizontal opening approximately in the plane of the sprinkler axis and laterally spaced from the sprinkler axis along with a generally horizontally extending vane located above each opening and extending away from the sprinkler orifice. Each semi-conical section opens outwardly in the direction away from the sprinkle axis with an included cone angle in a range from about 20° to about 60°, preferably in a range from about 30° to about 50°, and desirably about 40°, and the upper surface of each semi-conical section is flattened and extends laterally farther away from the sprinkler axis than the remainder of the semi-conical sections.

Preferably, the sprinkler has a K factor of about 8 and is designed for extended coverage, ordinary hazard occupancies providing protection to areas up to about 14 feet forwardly and 14 feet to each side of the sprinkler thereby permitting sprinklers to be placed along a side wall of a hall at about 28 foot intervals, for example.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
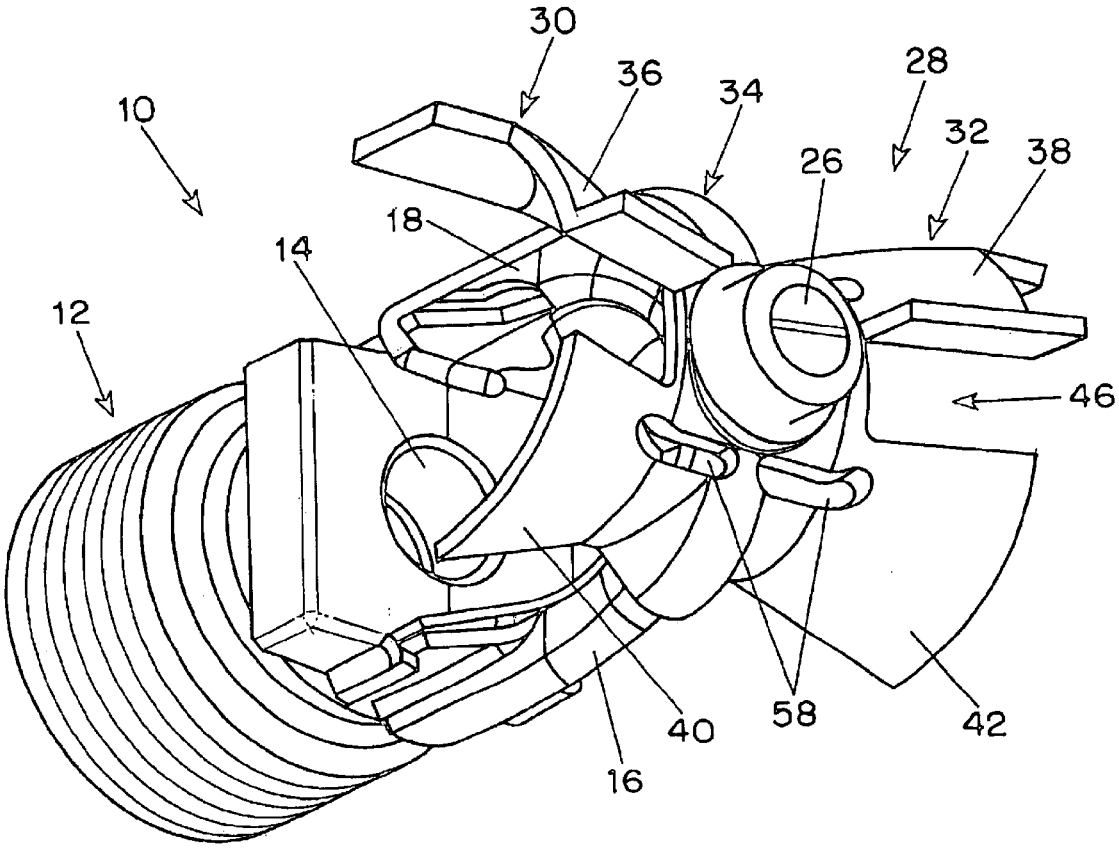
FIG. 1 is a perspective view from the bottom left front of a representative embodiment of a sprinkler arrangement according to the invention.
Figure 2:
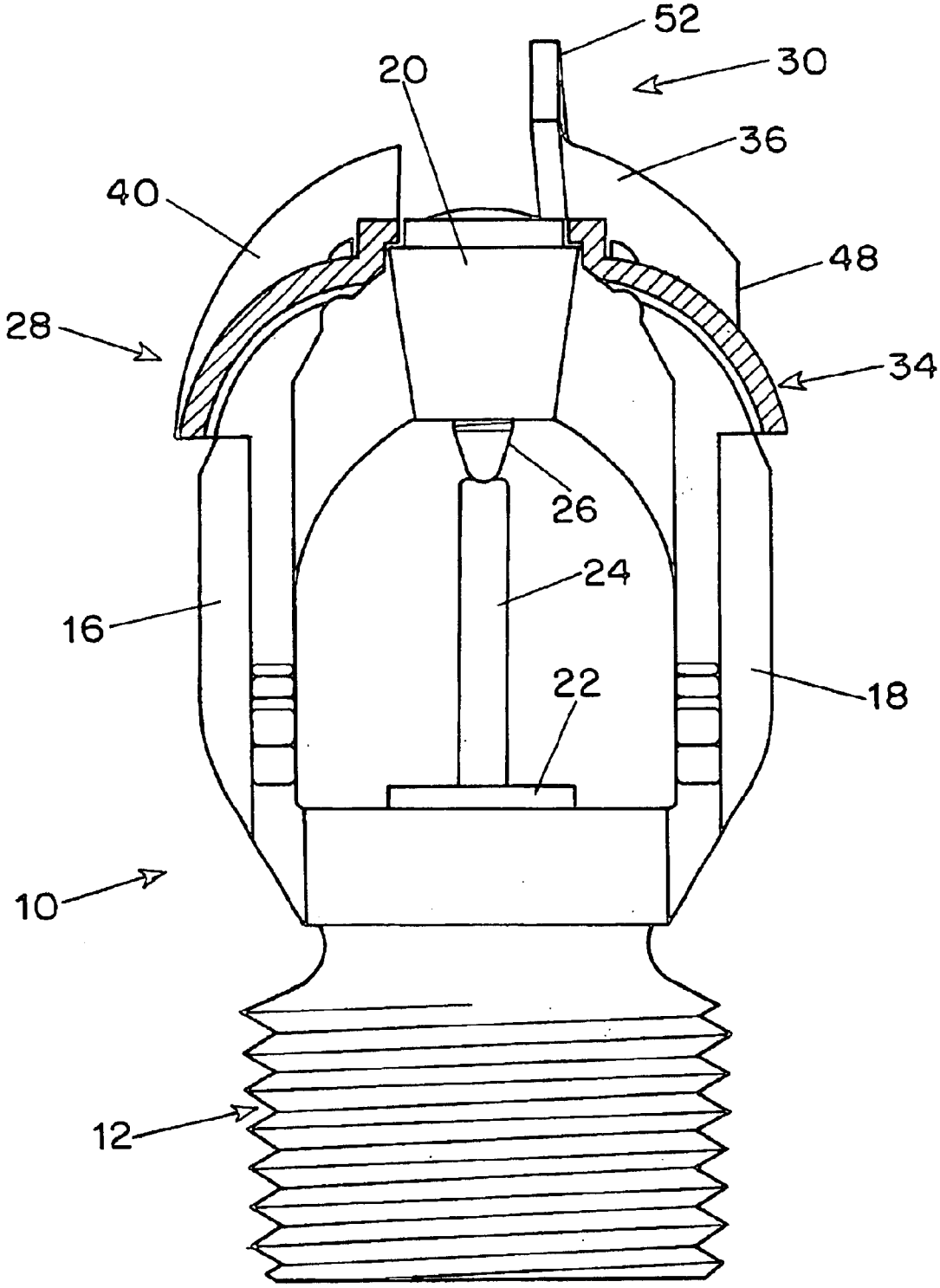
FIG. 2 is a side view partially in section showing the representative sprinkler arrangement illustrated in FIG. 1.

In the typical embodiment of the invention shown in the drawings, a horizontal sprinkler arrangement 10 includes a sprinkler body 12 having an internal axial opening terminating in an orifice 14 along with a pair of frame arms 16 and 18 extending forwardly from the sprinkler body on opposite sides and terminating in a boss 20 located on the sprinkler axis opposite the orifice 14. As seen in FIG. 2, the opening in the sprinkler body 12 is sealed by a plug 22 which is normally held in its sealing position by a thermally responsive device 24 extending between the plug 22 and a screw 26 projecting from the boss 20. The thermally responsive device 24 may be any conventional device such as a glass bulb or a linkage having a fusible element. For convenience of illustration, the plug 22 and the thermally responsive device 24 are not shown in FIG. 1.

In order to facilitate distribution of water passing through the orifice 14 in the desired manner, the frame arms 16 and 18 are oriented in a plane perpendicular to the lateral direction in which water is to be distributed, i.e., a vertical plane when the sprinkler is mounted horizontally in a side wall, for example, and a deflector 28 having two horizontally extending semi-conical sections 30 and 32 and a central section 34 surrounding the outer ends of the frame arms 16 and 18 is mounted on the boss 20.

Figure 5:
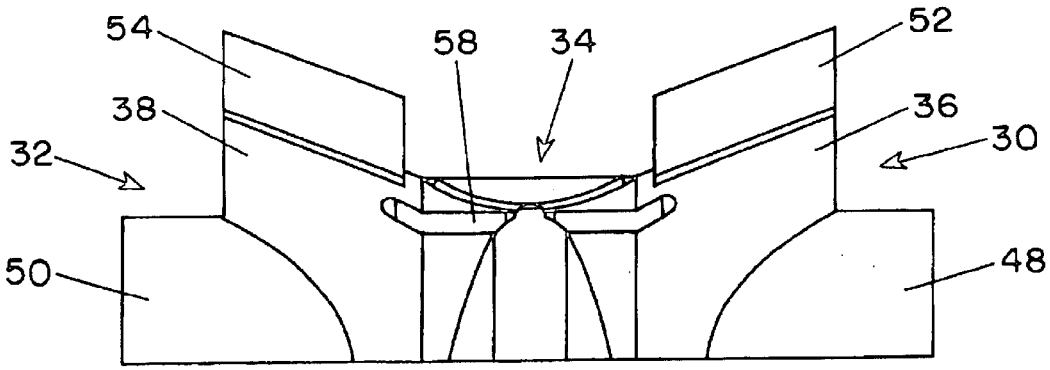
FIG. 5 is a top view of the deflector shown in FIG. 3.
Figure 3:
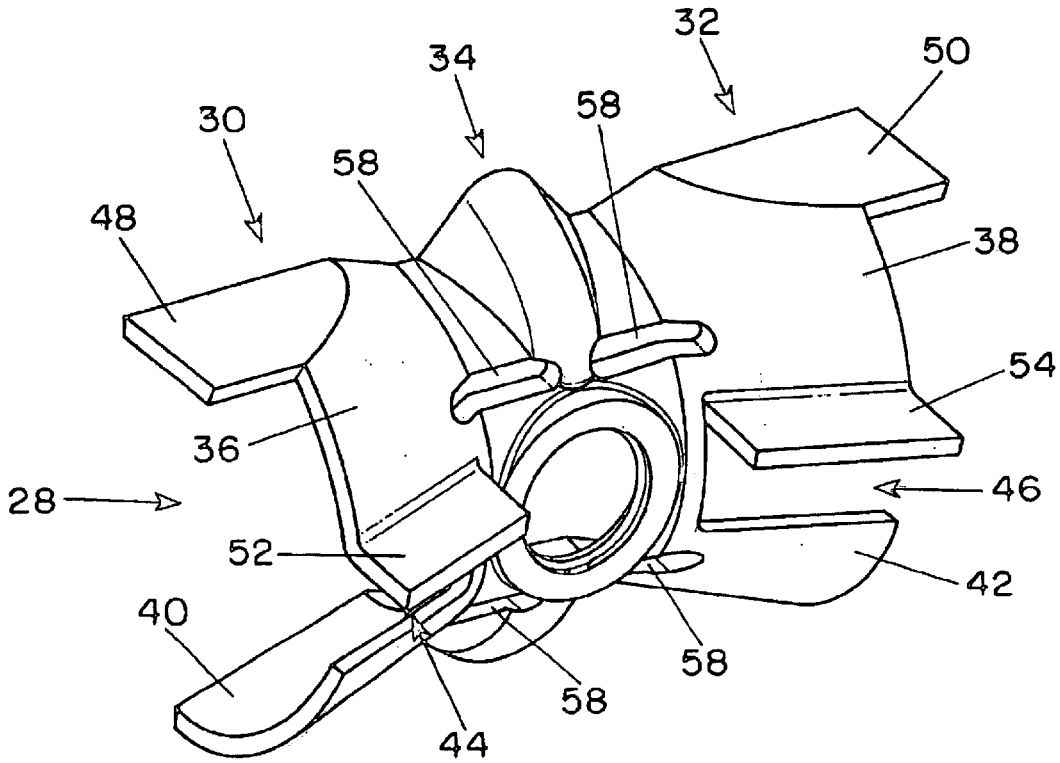
FIG. 3 is a top left front perspective view of the deflector for the sprinkler arrangement shown in FIGS. 1 and 2.
Figure 4:
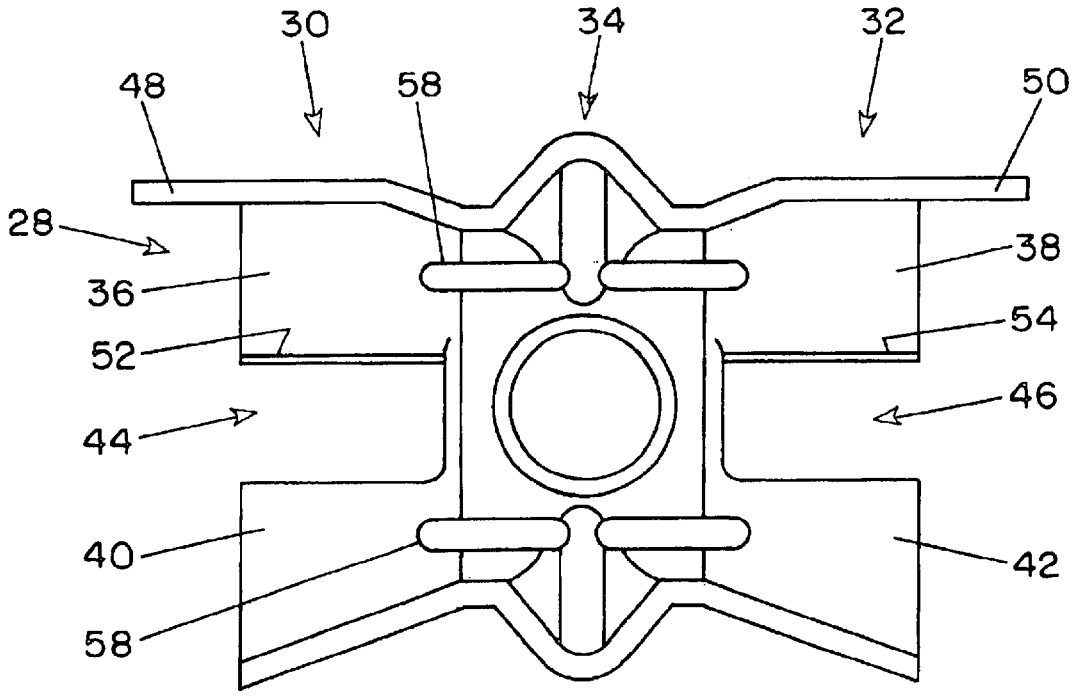
FIG. 4 is a rear view of the deflector shown in FIG. 3.

As shown in FIGS. 3 and 4 each semi-conical section 30 and 32 has an upper conical portion 36 and 38, respectively, and a lower conical portion 40 and 42, respectively, separated by a central horizontal opening 44 and 46, respectively, and the top surfaces 48 and 50 of the upper conical portions 36 and 38, respectively, are flattened so that they extend approximately in a horizontal plane. In addition, as best seen in FIGS. 3 and 5, each of the upper portions 36 and 38 has a forwardly extending vane 52 and 54, respectively, and horizontal slots 58 extend across the junctions of the three deflector sections 32, 34, and 36 above and below the axis of the sprinkler.

In a particular embodiment of the invention the sprinkler body 12 has an orifice 14 with a diameter of about 0.53 inch providing a K factor of about 8 and the sprinkler is arranged to protect an area extending about 14 feet forwardly and 14 feet to each side of the location of the sprinkler, providing extended coverage for ordinary hazard occupancies.

In the preferred embodiment the included angle of the conical surfaces 36, 38, 40 and 42 in the semi-conical sections 30 and 32 is in a range from about 20° to about 60°, preferably about 30° to about 50° and desirably about 40°, and the width of the deflector between opposite ends of the conical surfaces is in a range from about 1.7 inches to about 2.05 inches, preferably, about 1.8 to about 1.95 inches, and desirably about 1.87 inches, while the flattened horizontal top portions 48 and 50 extend beyond the edges of the conical surfaces by about 0.10 inch to about 0.40 inch, preferably about 0.20 inch to about 0.30 inch and desirably about 0.25 inch.

In addition, the width of the center section 34 is about 0.4 inch to about 0.6 inch, desirably about 0.5 inch and the height of the central openings 44 and 46 is about 0.2 inch to about 0.3 inch, desirably about 0.25 inch while the length of the vanes 52 and 54 in the forward direction is about 0.15 inch to about 0.25 inch, preferably about 0.2 inch.

With this arrangement effective extended coverage ordinary hazard protection for spaces extending about 14 feet forwardly and 14 feet to each side of each sprinkler is provided, thereby permitting such sprinklers to be spaced at about 28 foot intervals along a hall, for example.

Although the invention has been described herein with reference to specific embodiments, many modifications and variations therein will readily occur to those skilled in the art. Accordingly, all such variations and modifications are included within the intended scope of the invention.

We claim:

1. A horizontal sprinkler arrangement comprising:

a sprinkler body having an outlet orifice; and a deflector supported in spaced relation to the orifice in the sprinkler body including two semi-conical sections which are open in the direction toward the sprinkler orifice and extend away from the central section on opposite sides of the sprinkler axis wherein each semi-conical section has a horizontal opening and includes a generally horizontal vane extending forwardly above the opening.

2. A horizontal sprinkler arrangement according to claim 1 wherein the height of the horizontal openings in the semi-conical sections is about 0.2 inch to about 0.3 inch.

3. A horizontal sprinkler arrangement according to claim 2 wherein the height of the horizontal openings in the semi-conical sections is about 0.25 inch.

4. A horizontal sprinkler arrangement according to claim 1 wherein the generally horizontal vane has a length in the forward direction of about 0.15 inch to about 0.25 inch.

5. A horizontal sprinkler arrangement according to claim 4 wherein the length of the vane in the forward direction is about 0.2 inch.

6. A horizontal sprinkler arrangement according to claim 1 wherein each semi-conical section has a generally horizontal flat part at its upper side which extends away from the sprinkler axis to a greater extent than the remainder of the semi-conical sections.

7. A horizontal sprinkler arrangement according to claim 1 wherein the size of the orifice and the sprinkler body provides a K factor for the sprinkler of about 8.

8. A horizontal sprinkler arrangement according to claim 1 which provides extended coverage ordinary hazard protection for areas up to 14 feet forwardly and 14 feet to each side of the sprinkler axis.

9. A horizontal sprinkler arrangement according to claim 1 including a pair of frame arms supporting the deflector which are oriented in a vertical plane and have forward ends received within a central section of the deflector between the semi-conical sections.

10. A horizontal sprinkler arrangement according to claim 9 wherein the diameter of the cone-shaped sections at their junctions with the central section is in a range from about 0.65 inch to about 0.85 inch.

11. A horizontal sprinkler arrangement according to claim 10 wherein the diameter of the cone-shaped sections at their junction with the central section is about 0.75 inch.

12. A horizontal sprinkler arrangement according to claim 1 wherein the semi-conical sections include conical surfaces having an included cone angle in a range from about 20° to about 60°.

13. A horizontal sprinkler arrangement according to claim 12 wherein the included angle is in a range from about 30° to about 50°.

14. A horizontal sprinkler arrangement according to claim 13 wherein the included angle is about 40°.

15. A horizontal sprinkler arrangement according to claim 1 wherein the distance between opposite ends of the semi-conical sections is in a range from about 1.7 inch to about 2.05 inches.

16. A horizontal sprinkler arrangement according to claim 15 wherein the distance between opposite ends of the semi-conical sections is in a range from about 1.8 inches to about 1.95 inches.

17. A horizontal sprinkler arrangement according to claim 16 wherein the distance between opposite ends of the semi-conical sections is about 1.87 inches.

18. A horizontal sprinkler arrangement comprising:

a sprinkler body having an outlet orifice; and a deflector supported in spaced relation to the orifice in the sprinkler body including two semi-conical sections which are open in the direction toward the sprinkler orifice and extend away from the central section on opposite sides of the sprinkler axis wherein each semi-conical section has a generally horizontal flat part at its upper side which extends away from the sprinkler axis to a greater extent than the remainder of the semi-conical sections; and wherein the flat parts of the semi-conical sections extend about 0.15 inch to about 0.35 inch beyond the ends of the conical surfaces of those sections.

19. A horizontal sprinkler arrangement according to claim 18, wherein the flat parts of the semi-conical portions extend about 0.25 inch beyond the ends of the conical surfaces of the semi-conical sections.

* * * * *